US011268382B2

(12) United States Patent
Friederichs et al.

(10) Patent No.: US 11,268,382 B2
(45) Date of Patent: Mar. 8, 2022

(54) MILLING PICK

(71) Applicant: Betek GmbH & Co. KG, Aichhalden (DE)

(72) Inventors: Heiko Friederichs, Aichhalden (DE); Ulrich Krämer, Wolfach (DE)

(73) Assignee: Betek GmbH & Co. KG

( * ) Notice: Subject to any disclaimer, the term of this patent is extended or adjusted under 35 U.S.C. 154(b) by 0 days.

(21) Appl. No.: 17/046,598

(22) PCT Filed: Mar. 19, 2019

(86) PCT No.: PCT/EP2019/056859
§ 371 (c)(1),
(2) Date: Oct. 9, 2020

(87) PCT Pub. No.: WO2019/201534
PCT Pub. Date: Oct. 24, 2019

(65) Prior Publication Data

US 2021/0095564 A1 Apr. 1, 2021

(30) Foreign Application Priority Data

Apr. 17, 2018 (DE) ..... 10 2018 109 150.8

(51) Int. Cl.
*E21C 35/197* (2006.01)
*E21C 35/18* (2006.01)
*E21C 35/183* (2006.01)

(52) U.S. Cl.
CPC ..... *E21C 35/197* (2013.01); *E21C 35/18* (2013.01); *E21C 35/183* (2013.01); *E21C 35/1837* (2020.05)

(58) Field of Classification Search
CPC ..... E21C 35/193; E21C 35/1933; E21C 35/1936; E21C 35/18; E21C 35/19;
(Continued)

(56) References Cited

U.S. PATENT DOCUMENTS 6,357,832 B1 * 3/2002 Sollami ..... E21C 35/197 299/104
7,195,321 B1 3/2007 Sollami
(Continued)

FOREIGN PATENT DOCUMENTS

DE 29623215 U1 2/1998
DE 102007009711 A1 9/2008
(Continued)

OTHER PUBLICATIONS

International Search Report and Written Opinion for corresponding PCT/EP2019/056859, dated Jul. 1, 2019, 12 pages (not prior art).
(Continued)

*Primary Examiner* — Janine M Kreck
*Assistant Examiner* — Michael A Goodwin
(74) *Attorney, Agent, or Firm* — Lucian Wayne Beavers; Patterson Intellectual Property Law, PC

(57) ABSTRACT

The invention relates to a milling pick, in particular a round pick having a pick head (40), which has a pick tip (30) made of a hard material as a cutting element, wherein furthermore a pick shank (10) is provided, which is coupled directly or indirectly to the pick head (40), wherein a wear-protection disk (20) is provided, the cut-out of which, in particular a drilled hole, is pushed onto the pick shank (10),
wherein the wear-protection disk (20) has, on its side facing the pick head (40), a counterface (23), which is designed to come into contact with a bearing surface (41) of the pick head (40), wherein the wear protection disk has, facing away from the counterface (23), an underside support surface (21), which is preferably parallel to the counterface (23), and wherein a disk thickness (d) is formed between the counterface (23) and the support surface (21),
is characterized in that the ratio of the diameter of the pick shank (10) located in the area of the cut-out (25) to the
(Continued)

thickness of the disk (d) being in the range from 1.5 to 3.75, preferably in the range from 2 to 3.

13 Claims, 4 Drawing Sheets

(58) Field of Classification Search
CPC .... E21C 35/191; E21C 35/197; E21C 35/183; E21C 35/1831; E21C 35/1833; E21C 35/1835; E21C 35/1837
See application file for complete search history.

(56) References Cited

U.S. PATENT DOCUMENTS

| | | | | |
|---|---|---|---|---|
| 7,338,135 | B1 | 3/2008 | Hall et al. | |
| 8,550,569 | B2 | 10/2013 | Wöhrstein et al. | |
| 8,783,785 | B2 | 7/2014 | Lehnert et al. | |
| 9,234,424 | B1 | 1/2016 | Kammerer et al. | |
| 10,662,770 | B2 | 5/2020 | Kammerer et al. | |
| 2003/0047985 | A1* | 3/2003 | Stiffler | E21C 35/197 299/102 |
| 2004/0051370 | A1* | 3/2004 | Montgomery, Jr. | E21C 35/197 299/106 |
| 2008/0036272 | A1* | 2/2008 | Hall | E21C 35/197 299/104 |
| 2008/0036279 | A1 | 2/2008 | Hall et al. | |
| 2010/0194177 | A1 | 8/2010 | Wöhrstein et al. | |
| 2017/0030191 | A1* | 2/2017 | Kammerer | E21C 35/197 |
| 2017/0234128 | A1* | 8/2017 | Ries | E21C 35/183 299/10 |
| 2017/0254201 | A1* | 9/2017 | McCall | E02F 9/2841 |

FOREIGN PATENT DOCUMENTS

| | | | |
|---|---|---|---|
| DE | 102007030658 | A1 | 1/2009 |
| DE | 102009049780 | A1 | 4/2011 |
| DE | 102014104040 | A1 | 9/2015 |
| DE | 202017006713 | U1 | 3/2018 |
| GB | 2531125 | A | 4/2016 |
| TW | 201014963 | A | 4/2010 |

OTHER PUBLICATIONS

Parts and More Compact, Generation X brochure, Wirtgen Group, www.wirtgen-group.com, 54 pages.
Taiwan Office Action for corresponding patent application No. 108113175, dated Mar. 23, 2020, 1 page.
Germany Office Action for corresponding patent application No. 10 2018 109 150.8, dated Jan. 18, 2019, 10 pages.

* cited by examiner

MILLING PICK

The invention relates to a milling pick, in particular a round pick having a pick head and a pick tip, which has a pick tip made of a hard material as a cutting element, wherein furthermore a pick shank is provided, which is coupled directly or indirectly to the pick head, wherein a wear-protection disk is provided, the cut-out of which, in particular a drilled hole, is pushed onto the pick shank, wherein the wear-protection disk has, on its side facing the pick head, a counterface, which is designed to come into contact with a bearing surface of the pick head, wherein the wear-protection disk has, facing away from the counterface, an underside support surface, which is parallel to the counterface, and wherein a disk thickness is formed between the counterface and the support surface.

Such a pick is known from DE10 2014 104 040 A1. Starting from a cutting element, the diameter of the pick head increases towards a collar, which adjoins a pick shank. A clamping sleeve is used to hold the cylindrically designed pick shank in a pick receptacle in a holding attachment of a pick holder. The immobilization by means of the clamping sleeve permits the pick to rotate around its central longitudinal axis while any axial movement is blocked. A wear-protection disk is arranged between the pick head and the holding attachment, through the central receiving hole of which the pick shank is routed. Towards the pick head, the wear-protection disk has a recess framed by an edge, the bottom of which forms a support surface against which a bearing surface of the pick head rests. Towards the toolholder, the wear-protection disk forms a seating surface, which merges towards the center of the wear-protection disk into a centering surface of a centering attachment running at an angle to the central longitudinal axis of the pick. A groove is arranged in the transition area between the centering surface and the seat surface. The upper side of the toolholder's holding attachment is shaped towards the pick head matching the underside of the wear-protection disk. It has a wear surface, on which the seat of the wear-protection disk rests. The centering attachment of the wear-protection disk is radially guided in a centering receptacle of the holding attachment. As a result of wear of the wear surface during operation of the tool arrangement using the pick, a bulge forms on the wear surface of the toolholder in the area of the groove of the wear-protection disk, which engages with the groove. This engagement makes for additional lateral guidance of the wear-protection disk. At the same time, the groove and the bulge that engages in the former at least reduce the penetration of waste material into the area of the pick holder, thus maintaining the rotatability of the pick and reducing wear.

To ensure that the tool can be rotated around its central longitudinal axis, limited axial play of the tool in the toolholder is desired. More play is provided for larger bits than for smaller bits. If the axial play exceeds the height of the centering attachment, the wear-protection disk is no longer laterally guided by the centering attachment. This results in increased wear of both the wear-protection disk and the toolholder.

For this reason, DE 20 2017 006 713 U1 takes up this solution and suggests a better serration of the wear-protection disk and the toolholder. This measure can be used to improve the support behavior in transverse direction. All in all, radial forces can be transferred from the milling pick to the toolholder more effectively in this way. In addition, a greater load can be transferred in the transition area between the pick head and the pick shank. However, an increasing load also increases the risk of shaft fracture at this point.

The invention addresses the problem of providing a milling pick of the type mentioned above, which has an improved break resistance.

This task is solved by the ratio of diameter of the pick shank located in the area of the cut-out to the thickness of the disk (d) being in the range from 1.5 to 3.75, preferably in the range from 2 to 3.

In this way, the length of the pick head can be shortened to increase the thickness of the wear-protection disk, while maintaining the same absolute projection of the free end of the pick tip beyond the toolholder as in conventional designs of milling pick. With a shorter length of the pick head, the bending stresses occurring in the transition area between the pick head and the pick shank are lower, reducing the risk of the shaft breaking. The specified range from 1.5 to 3.75 allows for the stresses and strains occurring on and in milling picks that are commonly used in road construction, in particular for road milling machines and stabilizers, in an optimized manner. The preferred range ratio between 2 and 3 is suitable for road milling machines used for the partial or full removal of road pavements or the fine milling of road surfaces.

Modern milling picks often use wear-protection discs that do not have a uniform cross-section geometry. According to the invention, provision is in particular made that the ratio of the diameter of the pick shank located in the area of the cut-out to the minimum thickness of the disk (d) is in the range from 1.5 to 3.75, preferably in the range from 2 to 3.

In a preferred variant of the invention, the recesses are introduced into the counterface, wherein second surface segments of the counterface are formed between the recesses, and the second surface segments rest at least in some areas against the bearing surface of the pick head. During operation, the milling pick rotates relative to the wear-protection disk. Milling material is removed when the milling pick penetrates the ground/subgrade to be worked. This milled material may enter the area between the pick head and the wear-protection disk and then the area of the receiving hole of the toolholder, where the milling pick is mounted. In individual cases, this milled material accumulates in the receiving hole and restricts the free rotation of the milling pick or blocks it. The recesses, in combination with the areas raised opposite the recesses, form a kind of crushing mill. It can be used to grind penetrating particles. The finer components are then removed radially outwards to prevent them from reaching the area of the receiving hole of the toolholder.

In particular, it may be provided that the counterface adjacent to the cut-out has a first surface segment running annularly around the cut-out, which first surface segment adjoins the second surface segments, and wherein the first surface segment rests against the bearing surface of the pick head at least in some areas. The annular surface segment forms a kind of sealing segment, which also prevents the crushed fine particles from penetrating into the area of the receiving hole.

According to a further preferred invention variant, provision may be made for the recesses to merge into the second surface segments via inclined lateral flanks. In this way, the grinding effect is improved.

To improve the removal of the penetrated or crushed particles, provision may be made that the recesses have the greatest degree of indentation at their radially outer area in relation to the counterface and merge into the first surface segment at their radially inner area. In order not to reduce the stability of the wear-protection disk to an impermissible degree, it is recommended that the radially outer area of the recesses have a recess dimension of at most half the thickness of the disk, and particularly preferably of at most 30% of the thickness of the disk.

According to a conceivable variant of the invention, provision may be made that a centering attachment protrudes from the underside of the wear-protection disk, which centering attachment is arranged circumferentially around the cut-out and protrudes beyond the support surface at least in some areas. The centering attachment improves the lateral guidance and support of the wear-protection disk relative to the toolholder in the radial direction. The conical design of the centering attachment achieves the precise guidance of the wear-protection disk in relation to the toolholder in a simple manner.

A preferred design of the milling pick is such that the centering attachment merges into a, preferably circumferential, groove, which is recessed into the support surface. During operation, the wear-protection disk grinds itself into an assigned surface of the toolholder. In so doing, an annular and bulge-shaped attachment is created on this surface in the area of the circumferential groove. In conjunction with the groove and the centering attachment, this results in an improved transverse support of the wear-protection disk in the radial direction in relation to the toolholder. It has been shown that for typical road milling applications, in the axial direction of the tool shank the ratio of the spacing between the groove base of the groove and the free end of the centering attachment in relation to the disk thickness is ideally in the range from 30% to 70%.

According to a possible variant of the invention, it may also be provided that a form-fitting connection is provided between the wear-protection disk and the pick head and/or the pick shank in the circumferential direction.

The invention is explained in greater detail below based on exemplary embodiments shown in the drawings. In the Figures.

Figure 1:
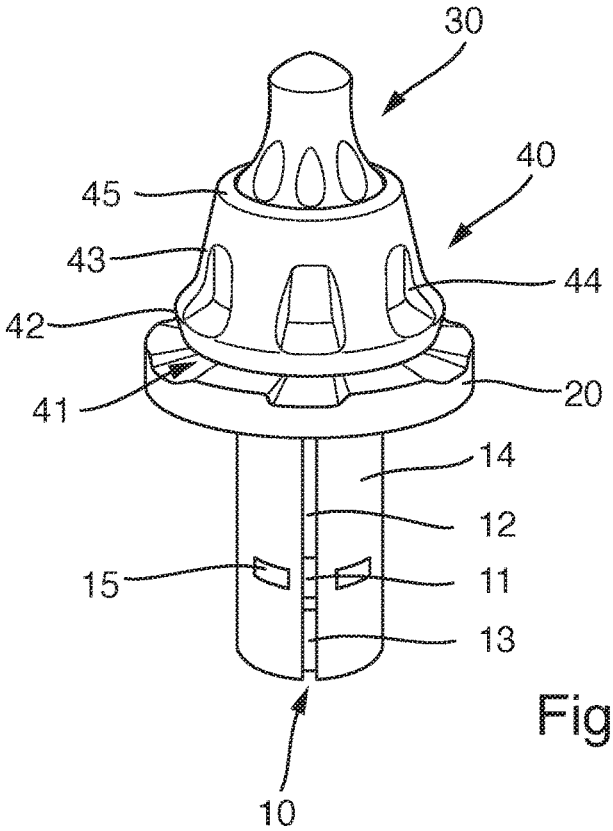
FIG. 1 shows a perspective side view of a first embodiment of a milling pick.

FIG. 1 shows a milling pick, in this case a round pick. This milling pick has a pick shank 10, to which a pick head 40 is integrally molded. An embodiment variant is also conceivable, in which the pick head 40 is not integrally molded to the pick shank 10, but is manufactured as a separate component and connected to the pick shank 10.

The pick shank 10 has a first segment 12 and an end segment 13. A circumferential groove 11 runs between the first segment 12 and the end segment 13. Both the first segment 12 and the end segment 13 are cylindrical. The groove 11 is located in the area of the free end of the pick shank 10.

A clamping element 14, which in this case has the shape of a clamping sleeve, is mounted on the pick shank 10. It is also conceivable to attach another clamping element 14 to the pick shank 10. The clamping element 14 is used to immobilize the milling pick in a receiving hole of a toolholder. The clamping sleeve can be used to fix the milling tool in the receiving hole of the toolholder in such a way that the outer circumference of the clamping sleeve fits tightly against the inner wall of the receiving hole in a clamping manner.

The clamping element 14 has retaining elements 15. These retaining elements 15 engage with the circumferential groove 11. In this way, the milling pick can rotate freely in the clamping element 14 in the circumferential direction, but is held captive in the axial direction.

The clamping element 14 may be designed to be a clamping sleeve, as stated above. For this purpose, the clamping sleeve can consist of a rolled sheet metal segment. The retaining elements 15 can be stamped into the sheet metal segment, projecting in the direction of the groove 11. It is also conceivable that the retaining elements are partially cut free from the material of the sheet metal segment and bent in the direction of the groove 11.

A wear-protection disk 20 is mounted to the pick shank 10. The wear-protection disk 20 is located in the area between the assigned end of the clamping element 14 and a pick head 40. The wear-protection disk 20 can be rotated relative to both the clamping element 14 and the pick head 40.

Figure 5:
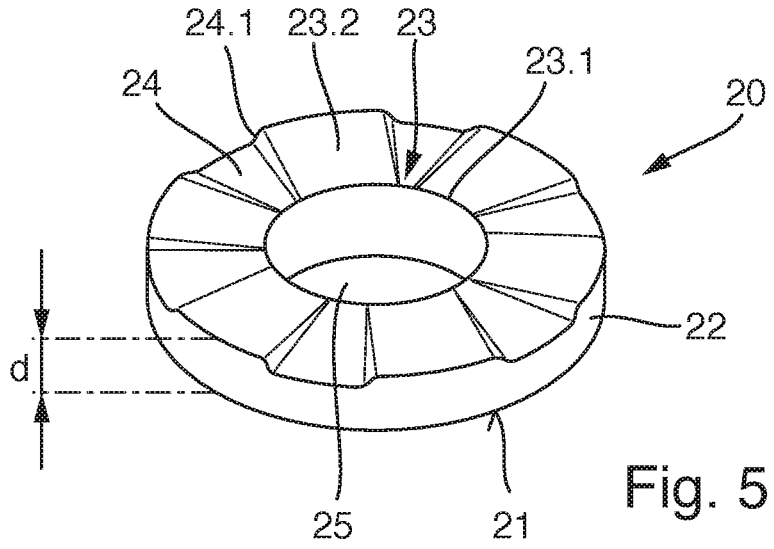
FIG. 5 shows a perspective view from above of a wear-protection disk (20) for use on one of the milling picks of FIG. 1 or 2.
Figure 6:
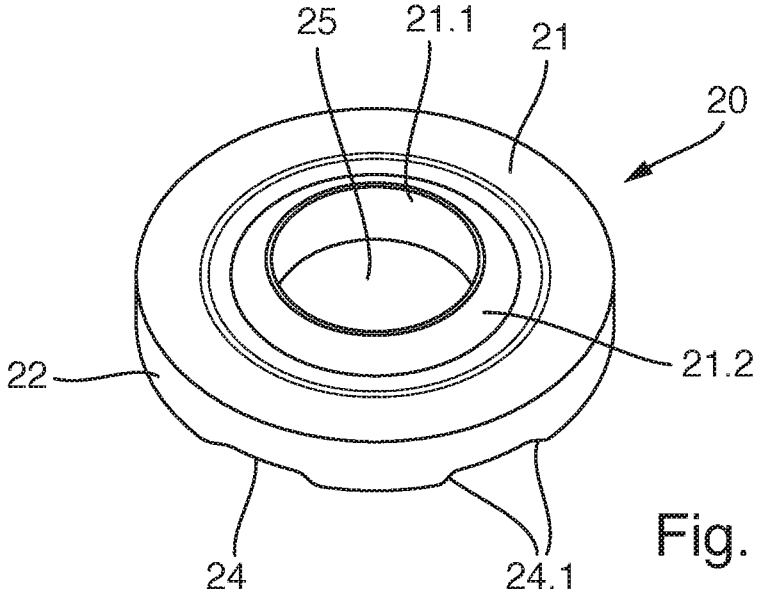
FIG. 6 shows a perspective bottom view of the wear-protection disk (20) of FIG. 5

The design of the wear-protection disk 20 can be seen in FIGS. 5 and 6. As these illustrations show, the wear-protection disk 20 can be of annular design. The wear-protection disk 20 has a central cut-out 25, which can be designed as a drilled hole. A polygon-shaped cut-out is also conceivable.

The wear-protection disk 20 has an upper counterface 23 and a support surface 21 on the underside facing away from the counterface 23. The support surface 21 can be aligned in parallel to the counterface 23. It is also conceivable that these two surfaces are at an angle from each other. Recesses 24 can be cut out from the counterface 23 or recessed into the counterface 23. In this exemplary embodiment, the recesses 24 are arranged equidistantly at a consistent division grid along the circumference. It is also conceivable that a varying division is provided. The recesses 24 divide the counterface 23 into individual surface segments 23.1, 23.2. Initially, a first surface segment 23.1 is formed, which is annular and revolves around the cut-out 25. The first surface segment 23.1 radially adjoins the second surface segments 23.2. The recesses 24 are used to space the second surface segments 23.2 at a distance from each. As FIG. 5 shows, the recesses 24 can merge into the adjacent second surface segments 23.2 via flank segments 24.1. The flanks 24.1 are inclined and extend at an obtuse angle to the second surface segment 23.2. As FIG. 5 further shows, the recesses 24 extend continuously towards the first surface segment 23.1. The surface segments 23.1, 23.2 form a level bearing surface for a pick head 40.

FIG. 6 shows the underside of the wear-protection disk 20. Here the support surface 21 is clearly visible. A circumferential groove 21.1 is recessed into the support surface 21. The circumferential groove 21.1 is directly or indirectly adjoined by a centering attachment 21.2. The centering attachment 21.2 is designed to be conical. It is arranged circumferentially around the cut-out 25 shaped like a drilled-hole.

On its outer circumference, the wear-protection disk 20 is limited by an annular circumferential rim 22.

Figure 2:
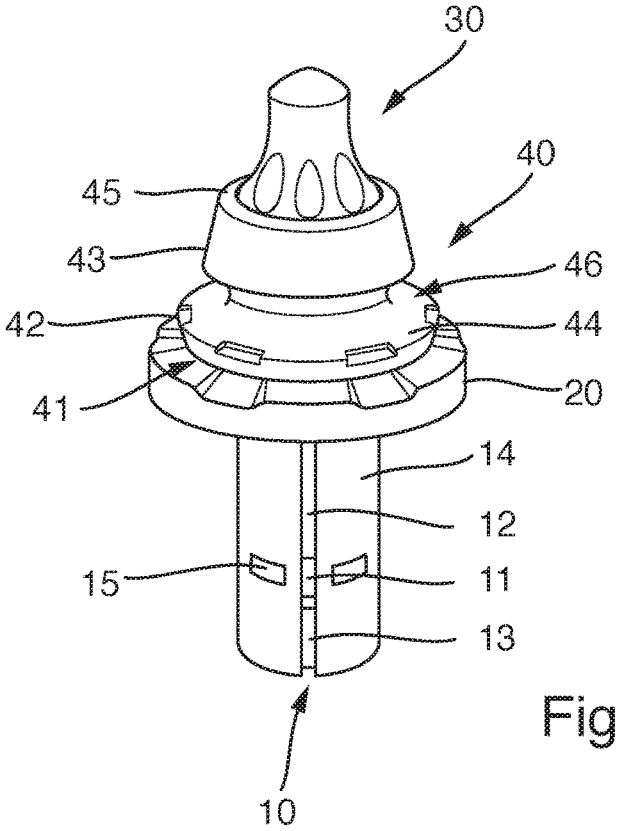
FIG. 2 shows a perspective side view of a second embodiment of a milling pick.

The cut-out of the wear-protection disk 20 can be slid onto the pick shank 10. In the mounted state, as shown in FIGS. 1 and 2, the cut-out 25 of the wear-protection disk 20 encloses a cylindrical segment of the milling pick. This cylindrical segment can be formed by the first segment 12 of the pick shank 10. Preferably, however, a further segment is connected to the first segment 12, which forms the cylindrical segment. The cylindrical segment is enlarged in diameter compared to the first segment 12 and concentric thereto.

It is also conceivable to use the wear-protection disk 20 as an assembly aid. In this case, the wear-protection disk 20 is mounted on the outer circumference of the clamping element 14. In this exemplary embodiment, the clamping element 14 is designed as a longitudinally slotted clamping sleeve. The cut-out 25 has a smaller diameter than the clamping sleeve in its spring-loaded state shown in FIGS. 1 and 2. When the cut-out 25 of the wear-protection disk 20 is then mounted to the outer circumference of the clamping sleeve, it is in a pretensioned state. This pretensioned state is selected in such a way that the clamping sleeve can be inserted into the receiving hole of a toolholder using little or no force. The insertion movement into the toolholder is then limited by the wear-protection disk 20. The support surface 21 at the bottom of the wear-protection disk then strikes against an assigned wear surface of the toolholder. The milling pick can then be driven further into the receiving hole of the toolholder, for instance by hitting it using a mallet. The wear-protection disk is pushed off the clamping sleeve until it reaches the position shown in FIG. 1 or 2. The clamping sleeve can then spring open more freely in the radial direction, wherein the clamping sleeve is used to clamp the milling tool in the receiving hole. In this state, the clamping sleeve is clamped to the milling tool in the receiving hole. The tool shank 10 can then be freely rotated in the clamping sleeve in the circumferential direction. The retaining elements 15 are used to hold it axially captive.

The wear-protection disk 20 has a disk thickness d between the support surface 21 and the counterface 23. The ratio of the diameter of the pick shank 10 located in the area of the cut-out 25, or the diameter of the cut-out 25, to the thickness d of the wear-protection disk 20 is in the range from 1.5 to 3.75, preferably in the range from 2 to 3. In this exemplary embodiment, this ratio is 2.8, for a disk thickness d of 7 mm. The disk thickness d is preferably selected in the range from 4.4 mm to 9.9 mm. For such a disk thicknesses d, an improvement can be achieved compared to the milling picks known from the state of the art. In particular, the head 40 of the milling pick can be made shorter in the axial direction of the milling pick, wherein the shortening of the pick head 40 is compensated for by the greater thickness of the wear-protection disk 20. However, the shorter pick head 40 can then be designed to have a constant outside diameter in the area of its base part 42. The shortened design of the pick head results in lower bending stress in the area between the pick head and the pick shank 10, which area is at risk of fracture. Accordingly, the equivalent tension here is also reduced in favor of an improved head and shaft fracture behavior.

The circumferential groove 21.1 arranged in the area of the support surface 21 provides improved transverse support behavior. During operation, the support surface 21 works its way into an assigned bearing surface of the toolholder. In the area of the circumferential groove 21.1, matching the circumferential groove 21.1, a circumferential bulge is produced at the toolholder like a negative. It is also conceivable to initially provide the toolholder with a bearing surface having a corresponding bulge when it is new. I.e., the centering attachment 21.1 then engages with a corresponding centering receptacle of the toolholder. The circumferential groove 21.1 comes to rest in the area of the bulge. This results in the improved transverse support behavior. Improved transverse support means that the surface pressures are reduced in the upper area of the clamping sleeve, i.e. in the area facing the pick head 40. This prevents excessive wear of the clamping sleeve in this area. The inventors recognized that excessive wear can result in a loss of pretension of the clamping sleeve. As a result of this loss of pretension, the milling pick may accidentally slip out of the toolholder's receiving hole and be lost. The improved support in the radial transverse direction, owing to the centering attachment 21.2 and the circumferential groove 21.1, therefore results in a longer tool life of the milling pick. When using the milling picks in road milling machines, the above-mentioned range of disk thickness d has proved to be advantageous. In this case, the wear-protection disks 20 will reliably fulfill their function for the entire extended service life of the milling pick, and the tool will not have to be replaced prematurely because of a worn clamping sleeve.

As described above, the circumferential groove 21.1 results in better transverse support behavior of the wear-protection disk 20 during operation. This also means that greater forces can be transmitted in radial direction between the wear-protection disk 20 and the toolholder. A greater disk thickness d in the manner described above results in the cut-out in the wear-protection disk 20 providing the pick shank 10 with a larger contact surface. In conjunction with the specified disk thickness d and the circumferential groove 21.1 in the underside of the wear-protection disk 20, greater lateral forces can be transmitted than is possible based on the current state of the art. In conjunction with the shorter design of the pick head, however, this also means that the new embodiment permits higher advance speeds to be achieved or, alternatively, the pick head or pick shank 10 can be designed with optimized tension levels to save material.

The dimensional relationships between the retaining element 15 and the pick shank 10 are set to enable a limited axial offset of the pick shank 10 relative to the retaining element 15. This generates a pumping effect in the axial direction of the milling pick during operation. If milled material enters the area between the bearing surface 41 of the pick head 40 and the counterface 23 during operation, the annular first surface segment 23 forms a kind of sealing area that minimizes the risk of waste material entering the area of the retaining element 15. A kind of mill effect is formed between the bearing surface 41 of the pick head 40 and the surface segments 23.2 and in connection with the flanks 24.1. Penetrating larger particles are crushed and removed via the inclined shape of the recesses 24. This also reduces the risk of material removed from the area of the pick shank 11 penetrating the tool.

As mentioned above, the milling pick has a pick head 40. The pick head 40 also has a lower contact surface 41. This contact surface 41 of the pick head can rest on the counterface 23. The contact surface 41 at least partially covers the annular first surface segment 23.1 and the second surface segments 23.2, as shown in FIGS. 1 and 2. The pick head 40 has a base part 42 adjacent to the bearing surface 41. In this exemplary embodiment the base part 42 is more bulge-shaped. However, other geometries are also conceivable. For example, it is conceivable to provide the base part 42 with a cylindrical geometry, a frustoconical geometry or similar. This base part 42 adjoins a wear surface 43. In this exemplary embodiment, the wear surface 43 has a concave design, at least in some areas, to optimize wear. The wear surface 43 merges into an end area of the pick head 40, which forms a receptacle 45 for a pick tip 30. As shown in the drawings, the end area of the pick head 40 may have a cap-shaped recess in the form of a receptacle 45. A pick tip 30 can be attached in the cap-shaped recess. It is conceivable to use a brazed joint to attach the pick tip 30.

Figure 4:
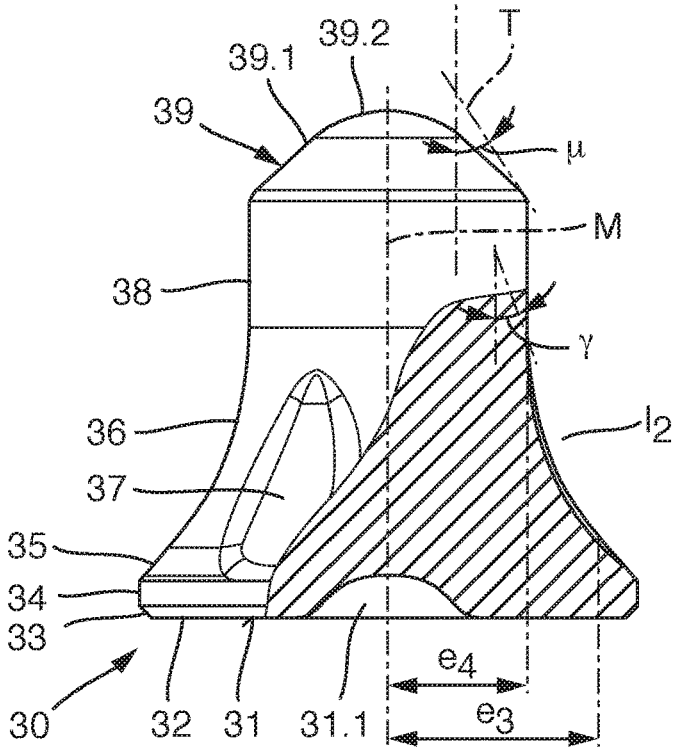
FIG. 4 shows a partially cut side view of the pick tip (30) of FIG. 3

The shape of the pick tip 30 is detailed in drawings 3 and 4. As these illustrations illustrate, the pick tip 30 has a mounting segment 31. In this exemplary embodiment, it is designed as the lower surface 31 of the pick tip 30. As shown in FIG. 4, this lower surface may be provided with a recess 31.1, which may in particular be trough-shaped. The recess 31.1 forms a reservoir, in which excess brazing material can accumulate. In addition, the recess 31.1 reduces the amount of material required to produce the pick tip 30. Usually the pick tip 30 is made of a hard material, especially carbide. That is a relatively expensive material. The recess 31.1 can therefore be used to reduce the effort and expenditure for manufacturing the parts required.

There are attachments 32 on the mounting segment 31 in the area of the underside of the pick tip 30. These attachments 32 can be used to adjust the thickness of the brazing gap between the plane mounting segment 31 and an assigned surface of the pick head 40.

The mounting segment 31 merges into a collar 34 via a chamfer 33. It is also conceivable that there could be a different transition from the mounting segment 31 to the collar 34. In particular, a direct transition of the mounting segment 31 into the collar 34 may also be provided. In this embodiment, the collar 34 is cylindrical. It is also conceivable to make the collar 34, for instance, convexly curved and/or more bulged. The collar 34 can directly or indirectly merge into a concave area 36. The exemplary embodiment shown in the drawings shows the design of an indirect transition. Accordingly, the collar 34 merges via a conical or convexly curved transition segment 35 into the concave area 36.

The concave area 36 can directly or indirectly merge into a connection segment 38. In this case, the design of an immediate transition to the connection segment 38 has been chosen. The connection segment 38 can be cylindrical, as shown in this exemplary embodiment. It is also conceivable to choose a frustoconical shape for the connection segment 38. Slightly convex or concave shapes of the connection segment 38 can also be used. A cylindrical connection segment 38 has the advantage of a design optimized in terms of material and strength. In addition, the connection segment 38 forms a wear area that is reduced during operation, while the pick tip 30 wears out. In this respect, a constant cutting effect is achieved by the cylindrical design of the connection segment 38.

The connection segment 38 is directly or indirectly adjoined by an end segment 39. In this case, an indirect transition is selected, wherein the transition is created by a chamfered contour 39.3. The end segment 39 has a tapered segment 39.1 and an end cap 39.2. Starting with the tapered segment 39.1, the cross-section of the pick tip 30 tapers towards the end cap 39.2. In this respect, especially the end cap 39.2 is the active cutting element of the pick tip 30.

In this exemplary embodiment, the outer contour of the end cap is formed by a spherical dome. The base circle of this spherical dome has a diameter 306. To achieve the sharpest possible cutting effect and, at the same time, a fracture-resistant design of the pick tip 30, it is advantageous if the diameter 306 of the base circle is selected in the range from 1 to 20 mm.

Figure 3:
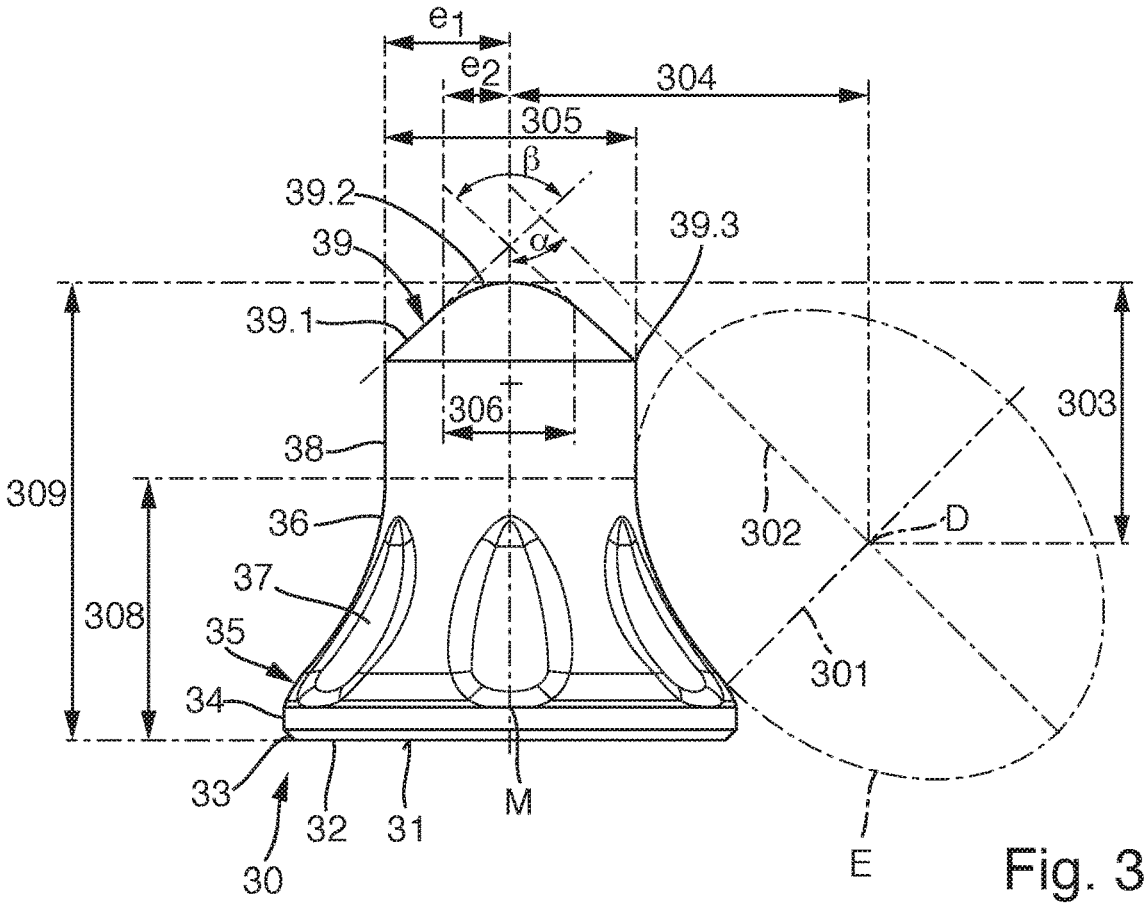
FIG. 3 shows a side view of a pick tip (30) for use on one of the milling picks of FIG. 1 or 2.

The first end area of the tapered segment 39.1 has a maximum first radial extension e1 facing the pick head 40. At its end facing away from the pick head 40, the tapered segment 39.1 has a second maximum radial extension e2. FIG. 3 shows a connection line from a point of the first maximum extension el to a point of the second maximum extension e2 as a dashed line. This connection line is at an angle β/2 of 45° to 52.5° from the central longitudinal axis M of the pick tip 30. An angle of 50° is preferably selected.

In this case, a spherical geometry of the tapered segment 39.1 has been selected. However, it is also conceivable to select a slightly convex or concave geometry that tapers towards the end cap 39.2.

During the machining operation, the pick tip 30 wears down, shortening in the direction of the central longitudinal axis M. In road milling applications, it has been shown that, given the setting angles of the milling picks selected here, the existing angular range of the connection line proves to be particularly advantageous compared to a milling drum, on which the milling picks are mounted. If a larger angle is selected, too much penetration resistance is caused during the milling process. This results in more required drive power of the milling machine. In addition, the main pressure point for wear action in the transition area between the connection segment 38 and the tapered segment 39.1 then acts on the pick tip 30. This results in an increased risk of edge breakage and premature failure of the pick tip 30. If a smaller angle is selected, the pick tip 30 is initially too efficient in cutting, resulting in high initial longitudinal wear. This reduces the maximum possible service life. For the angle range according to the invention, the effect of pressure during the milling process is distributed evenly over the surfaces of the tapered segment 39.1 and the end cap 39.2. This results in an ideal tool life for the pick tip and at the same time a sufficient cutting efficiency of the milling pick tip 30.

The pick tip 30 has an axial extension 309 in the direction of the central longitudinal axis M in the range from 10 to 30 mm. This area of extension has been optimized for road milling applications. The connection segment 38, which forms the main wear area, can have an axial extension in the range from 2.7 to 7.1 mm.

The concave area 36 of the pick tip 30 has an elliptical contour. The ellipse E creating the elliptical contour is shown as a dashed line in FIG. 3. The ellipse E is arranged such that the large semi-axis 302 of the ellipse E and the central longitudinal axis M of the pick tip 30 form an acute angle a. In this exemplary embodiment, the angle a is selected in the range from 30° to 60°, preferably from 40° to 50°, the angle, as shown here, is particularly preferably 45°. The concave area therefore has a geometry that follows the ellipse E. Preferably, the length of the semimajor 302 is selected in the range from 8 mm to 15 mm. In the version shown in FIG. 3, the length of the semimajor 302 is 12 mm. The length of the semiminor is selected in the range from 5 mm to 10 mm. In FIG. 3, a length of 9 mm is selected for the semiminor 301.

As FIG. 3 illustrates, the center D of the ellipse E is preferably spaced apart from the transition point between the concave area 36 and the connection segment 38 in the direction of the central longitudinal axis M, wherein the center D is offset from this connecting point in the direction of the pick head 40. This results in a wear-optimized geometry of the concave area 36.

Figure 7:
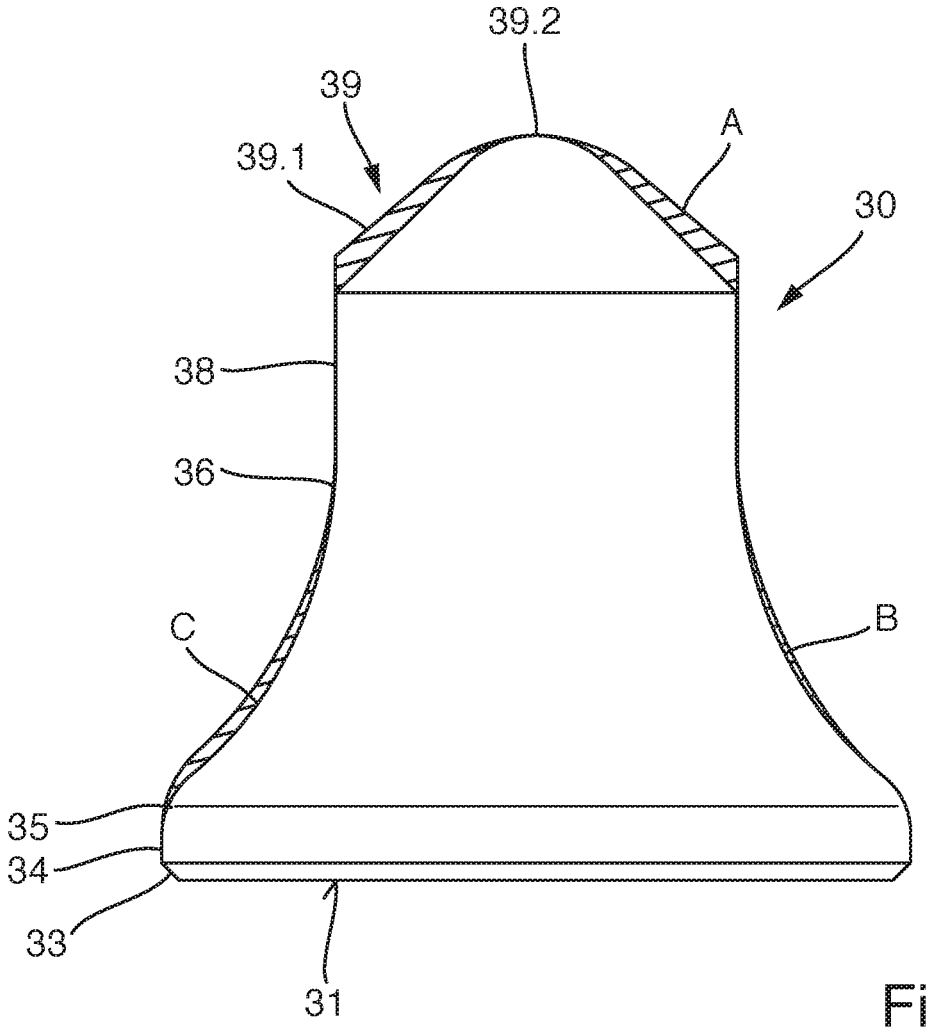
FIG. 7 shows a side view of a pick tip (30) in a comparison position.

FIG. 7 illustrates the effect of the inclination of the ellipse E. FIG. 7 shows a pick tip 30, in which, in accordance with the state of the art as known from DE 10 2007 009 711 A1, a concave contour is selected in the concave area 36 of the pick tip 30, in which the semimajor of the generating ellipse E is arranged in parallel to the central longitudinal axis M of the pick tip 30. As a result of the inclination of the ellipse E, an additional circumferential material area B results. This additional circumferential material area B reinforces the contour of the pick tip 30 in the most heavily stressed area of the pick tip 30. This is the area, in which the highest equivalent tension occurs. Consequently, due to the inclined position of the generating ellipse E, the pick tip 30 is reinforced in the relevant area without requiring a significantly higher amount of material. The pick tip 30 remains slim and retains its cutting efficiency.

On the left side in FIG. 7, in contrast, a contour of the concave area 36 is shown, which has an additional circumferential material area C opposite from the pick tip 30. The contour of this additional circumferential material area C is generated by a radius-shaped geometry, i.e. a circle. It becomes evident that, compared to the material area B, a significant thickening of the pick tip 30 is achieved. As a result, the strength in the critical area of the pick tip 30 is not or only slightly improved compared to the variant having the material area B (inclined ellipse E). At the same time, however, a significantly higher amount of the expensive hard material is required and the pick tip 30 loses its cutting efficiency.

FIG. 7 also illustrates the feature described above, whereby provision is made that in the cross-section of the pick tip 30, a connection line from a point of the first maximum extension e1 to a point of the second maximum extension e2 is at an angle β/2 of 45° to 52.5° from the central longitudinal axis M of the pick tip 30. As the illustration shows, an additional circumferential material area A is created by positioning the connection line at an angle. This additional material area A adds on the one hand additional wear volume in the mostly stressed cutting area and on the other hand has the advantages described above.

The invention claimed is:

1. A milling pick, comprising:

a pick head including a bearing surface;

a pick shank coupled directly or indirectly to the pick head;

a pick tip made of a hard material harder than the pick head, the pick tip being connected to the pick head;

a wear-protection disk including a cut-out, the pick shank being received through the cut-out, the wear-protection disk including:

a counterface configured to engage the bearing surface of the pick head;

an underside support surface; and a disk thickness defined between the counterface and the underside support surface at an outer periphery of the wear-protection disk; and wherein a ratio of a diameter of the pick shank adjacent the cut-out to the disk thickness is in a range of from 1.5 to 3.75;

wherein the wear-protection disk includes a centering attachment protruding from the underside support surface, the centering attachment being arranged circumferentially around the cut-out and protruding beyond the underside support surface at least in some areas;

wherein the wear-protection disk includes a circumferential groove in the underside support surface; and wherein the centering attachment merges into the circumferential groove.

2. The milling pick of claim 1, wherein:

the ratio of a diameter of the pick shank adjacent the cut-out to the disk thickness is in a range of from 2 to 3.

3. The milling pick of claim 1, wherein:

the underside support surface is parallel to the counterface.

4. The milling pick of claim 1, wherein:

the cut-out is a drilled hole.

5. The milling pick of claim 1, wherein:

the counterface includes recesses configured such that second surface segments of the counterface are formed between the recesses; and wherein the second surface segments rest at least in some areas against the bearing surface of the pick head.

6. The milling pick of claim 5, wherein:

the counterface includes a first surface segment running annularly around the cut-out; and wherein the first surface segment adjoins the second surface segments, and the first surface segment rests against the bearing surface of the pick head at least in some areas.

7. The milling pick of claim 1, wherein:

the centering attachment is frusto-conical in shape.

8. The milling pick of claim 1, wherein:

a ratio of a spacing between a groove base of the groove and a free end of the centering attachment to the disk thickness is in a range of from 30% to 70%.

9. The milling pick of claim 1, wherein:

the wear protection disk and the pick shank are configured such that a form-fitting connection is provided between the wear-protection disk and the pick shank around a circumference of the pick shank.

10. A milling pick, comprising:

a pick head including a bearing surface;

a pick shank coupled directly or indirectly to the pick head;

a pick tip made of a hard material harder than the pick head, the pick tip being connected to the pick head;

a wear-protection disk including a cut-out, the pick shank being received through the cut-out, the wear-protection disk including:

a counterface configured to engage the bearing surface of the pick head;

an underside support surface; and a disk thickness defined between the counterface and the underside support surface at an outer periphery of the wear-protection disk;

wherein a ratio of a diameter of the pick shank adjacent the cut-out to the disk thickness is in a range of from 1.5 to 3.75;

wherein the counterface includes recesses configured such that second surface segments of the counterface are formed between the recesses;

wherein the second surface segments rest at least in some areas against the bearing surface of the pick head; and wherein the counterface includes inclined lateral flanks merging the recesses into the second surface segments.

11. A milling pick, comprising:

a pick head including a bearing surface;

a pick shank coupled directly or indirectly to the pick head;

a pick tip made of a hard material harder than the pick head, the pick tip being connected to the pick head;

a wear-protection disk including a cut-out, the pick shank being received through the cut-out, the wear-protection disk including:

a counterface configured to engage the bearing surface of the pick head;

an underside support surface; and a disk thickness defined between the counterface and the underside support surface at an outer periphery of the wear-protection disk;

wherein a ratio of a diameter of the pick shank adjacent the cut-out to the disk thickness is in a range of from 1.5 to 3.75;

wherein the counterface includes recesses configured such that second surface segments of the counterface are formed between the recesses;

wherein the second surface segments rest at least in some areas against the bearing surface of the pick head;

wherein the counterface includes a first surface segment running annularly around the cut-out; and wherein the recesses are inclined in a radially outward direction such that the recesses have a greatest depth at radially outer areas of the recesses, and the recesses merge into the first surface segment at radially inner areas of the recesses.

12. The milling pick of claim 11, wherein:

the greatest depth of the recesses is no greater than one-half of the disk thickness at the radially outer areas of the recesses.

13. The milling pick of claim 11, wherein:

the greatest depth of the recesses is no greater than 30% of the disk thickness at the radially outer areas of the recesses.

* * * * *